US009960511B2

(12) United States Patent
Tamai

(10) Patent No.: US 9,960,511 B2
(45) Date of Patent: May 1, 2018

(54) ELECTRICAL CONNECTOR FOR CIRCUIT BOARDS AND ELECTRICAL CONNECTOR ASSEMBLY FOR CIRCUIT BOARDS

(71) Applicant: Hirose Electric Co., Ltd., Tokyo (JP)

(72) Inventor: Nobuhiro Tamai, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days. days.

(21) Appl. No.: 15/681,310

(22) Filed: Aug. 18, 2017

(65) Prior Publication Data

US 2018/0076546 A1 Mar. 15, 2018

(30) Foreign Application Priority Data

Sep. 9, 2016 (JP) ..... 2016-176891

(51) Int. Cl.

| | |
|---|---|
| ***H01R 12/71*** | (2011.01) |
| ***H01R 13/28*** | (2006.01) |
| ***H01R 13/193*** | (2006.01) |
| ***H01R 12/91*** | (2011.01) |
| ***H01R 13/631*** | (2006.01) |

(52) U.S. Cl.

CPC ..... *H01R 12/716* (2013.01); *H01R 12/91* (2013.01); *H01R 13/193* (2013.01); *H01R 13/28* (2013.01); *H01R 13/6315* (2013.01)

(58) Field of Classification Search

CPC .... H01R 12/716; H01R 13/193; H01R 13/28; H01R 12/91; H01R 13/6315

USPC ..... 439/74, 247, 248

See application file for complete search history.

(56) References Cited

U.S. PATENT DOCUMENTS

| | | | | |
|---|---|---|---|---|
| 4,334,732 | A * | 6/1982 | Roeschlein | H01R 13/6315 439/248 |
| 9,478,924 | B2 * | 10/2016 | Tamai | H01R 24/60 |
| 9,484,656 | B2 * | 11/2016 | Doi | H01R 12/65 |
| 2011/0294326 | A1 * | 12/2011 | Tanaka | H01R 12/712 439/248 |
| 2015/0140841 | A1 * | 5/2015 | Watanabe | H01R 12/7011 439/74 |

FOREIGN PATENT DOCUMENTS

JP 2016-115488 A 6/2016

* cited by examiner

*Primary Examiner* — Tulsidas C Patel
*Assistant Examiner* — Travis Chambers
(74) *Attorney, Agent, or Firm* — Procopio, Cory, Hargreaves & Savitch LLP

(57) ABSTRACT

The connector has multiple connection elements arranged on a circuit board and supports which support the connection elements. The connection elements have terminals connected to counterpart terminals in a counterpart connector, as well as stationary retainers and movable retainers that secure the terminals in place. The terminals have connecting portions at one end of the terminals, and contact portions at the other end, and the contact portions are secured in place on one side of the movable retainers. Flexible portions are formed between the movable retainers and the stationary retainers. The movable retainers are provided with biasing members on the other side opposite to the side on which the contact portions are positioned.

5 Claims, 7 Drawing Sheets

ELECTRICAL CONNECTOR FOR CIRCUIT BOARDS AND ELECTRICAL CONNECTOR ASSEMBLY FOR CIRCUIT BOARDS

CROSS REFERENCE TO RELATED APPLICATIONS

This Paris Convention Patent Application claims benefit under 35 U.S.C. § 119 and claims priority to Japanese Patent Application No. JP 2016-176891, filed on Sep. 9, 2016, titled "ELECTRICAL CONNECTOR FOR CIRCUIT BOARDS AND ELECTRICAL CONNECTOR ASSEMBLY FOR CIRCUIT BOARDS", the content of which is incorporated herein in its entirety by reference for all purposes.

BACKGROUND

Technical Field

The present invention relates to electrical connectors for circuit boards and electrical connector assemblies for circuit boards.

Background Art

Among electrical connectors for circuit boards (hereinafter referred to as "connectors"), there have been proposed connectors of a type that permits so-called "floating", i.e. terminal flexibility in a direction parallel to a mounting surface of a circuit board, onto which said connectors are to be mounted. Such a connector has been disclosed, for instance, in Patent Document 1.

In the connector of Patent Document 1, a single connection element is formed by providing a connecting portion at one end in the longitudinal direction of a terminal that extends in a direction perpendicular to a mounting surface and a contact portion at the other end thereof, and then securing said terminal in place between the connecting portion and the contact portion using a stationary retainer in a position that is closer to the connecting portion and, in addition, a movable retainer in a position that is closer to the contact portion than said stationary retainer, whereupon a connector is obtained by enclosing multiple connection elements in a casing. The stationary retainers, as well as the movable retainers, are made from an electrically insulating material. The section of the terminal between the stationary retainer and the movable retainer is a flexible portion that is more readily deflectable than other sections. In such a connection element, when the contact portion formed at the distal end of a section protruding from the movable retainer in the direction of a counterpart connector comes into contact with a counterpart terminal provided in a counterpart connector and is subject to lateral contact pressure perpendicular to the longitudinal direction of the above-mentioned terminal, flexural deformation occurs in the above-mentioned flexible portion, thereby enabling floating and allowing the connector to handle the eventual displacement of the counterpart connector from its regular position in the above-mentioned lateral direction.

PRIOR ART DOCUMENTS

Patent Documents

Patent Document 1:
Japanese Patent Application No. 2016-115488

SUMMARY

Problem to be Solved by the Invention

This type of connector necessitates having a small height dimension relative to the mounting surface of the circuit board, in other words, a low profile.

However, in the above-described Patent Document 1, in the multiple connection elements that form the connector, a terminal protrudes from the movable retainer toward the counterpart connector and a contact portion is provided at the distal end thereof. As a result, during contact with a counterpart terminal, it undergoes lateral bending, thereby ensuring contact pressure. Since the terminal markedly protrudes from the movable retainer, a low profile for the connector cannot be achieved.

In view of these circumstances, it is an object of the present invention to provide an electrical connector for circuit boards and an electrical connector assembly for circuit boards with a low profile, in which the portion of the terminal that protrudes from the movable retainer toward the counterpart connector is made as short as possible, or does not protrude at all.

Means for Solving the Problem

It is an object of the invention to provide a floating-enabled low-profile electrical connector for circuit boards and an assembly of such connectors. The inventive electrical connector for circuit boards is disposed on a mounting surface of a circuit board.

In the present invention, this electrical connector for circuit boards comprises a plurality of connection elements arranged such that a direction parallel to a mounting surface of a circuit board is the array direction, and supports that support the above-mentioned plurality of connection elements; the above-mentioned connection elements have terminals that connect to counterpart terminals provided in a counterpart connector and stationary retainers and movable retainers of an electrically insulating material that secure said terminals in place; the above-mentioned terminals have connecting portions connected to the mounting surface at one end in the longitudinal direction of said terminals and contact portions that come into contact with the counterpart terminals at the other end in the longitudinal direction, the above-mentioned contact portions being secured in place on one lateral face of the movable retainers and secured in place by the stationary retainers between said movable retainers and the above-mentioned connecting portions, with flexible portions formed between the movable retainers and the stationary retainers; the above-mentioned movable retainers have biasing members provided on the other lateral face opposite to the lateral face on which the contact portions are located; and, when the connector is connected to the counterpart connector, the above-mentioned biasing members apply pressure to other adjacent connection elements with a biasing force, as a result of which their reaction force causes the contact portions to come into contact with the counterpart terminals of the counterpart connector and apply a contact pressure thereto.

In the thus configured inventive connector, the terminals do not protrude from the movable retainers toward the counterpart connector, and the contact portions located on one lateral face of the movable retainers are biased by the biasing members on the other lateral face, thereby ensuring contact pressure. Therefore, the terminals do not protrude from the movable retainers toward the counterpart connector, thereby ensuring a correspondingly low profile.

In the present invention, the connection elements can be disposed so as to be paired with other adjacent connection elements by being disposed such that the surfaces on which the biasing members are provided face each other. Thus, if the connection elements are disposed so as to be paired with adjacent connection elements, the biasing members of the paired connection elements provide joint biasing, which makes it possible to ensure contact pressure.

In the present invention, the paired connection elements can be disposed such that the counterpart terminals of the counterpart connector are located on both external sides on which the contact portions of the two connection elements are located.

In the present invention, the connection elements can have shielding plates secured in place by the movable retainers so as to be positioned between the terminals and the biasing members. By doing so, a shielding effect for the contact portions is obtained.

In the present invention, an electrical connector assembly for circuit boards can be formed such that a first connector comprises the above-described connection elements and the other connector, which is the counterpart connector, comprises connection elements of the same configuration as said first connector. In this connector assembly, as a result of creating a mating connection between connectors of identical configuration, lateral pressure is applied by the flexible portions of the first connector to the movable retainers of the other connector, and, in addition, by the flexible portions of that connector to the movable retainers of the first connector, such that contact pressure is obtained between the contact portions of the terminals of the two connectors.

Effects of the Invention

As described above, in the present invention, instead of allowing the terminals to protrude from the movable retainers securing the terminals in place in the direction of the counterpart connector such that the connection elements make floating possible and providing contact portions at their distal ends, the contact portions are positioned on one lateral face of the movable retainers and biasing members are provided on the other lateral face. Contact pressure is ensured by the action of the biasing force originating from the biasing members of other adjacent connection elements, as a result of which the terminals do not protrude from the movable retainers, thereby ensuring a correspondingly low profile for the connector.

DETAILED DESCRIPTION

Embodiments of the present invention are described below with reference to the accompanying drawings.

Figure 1:
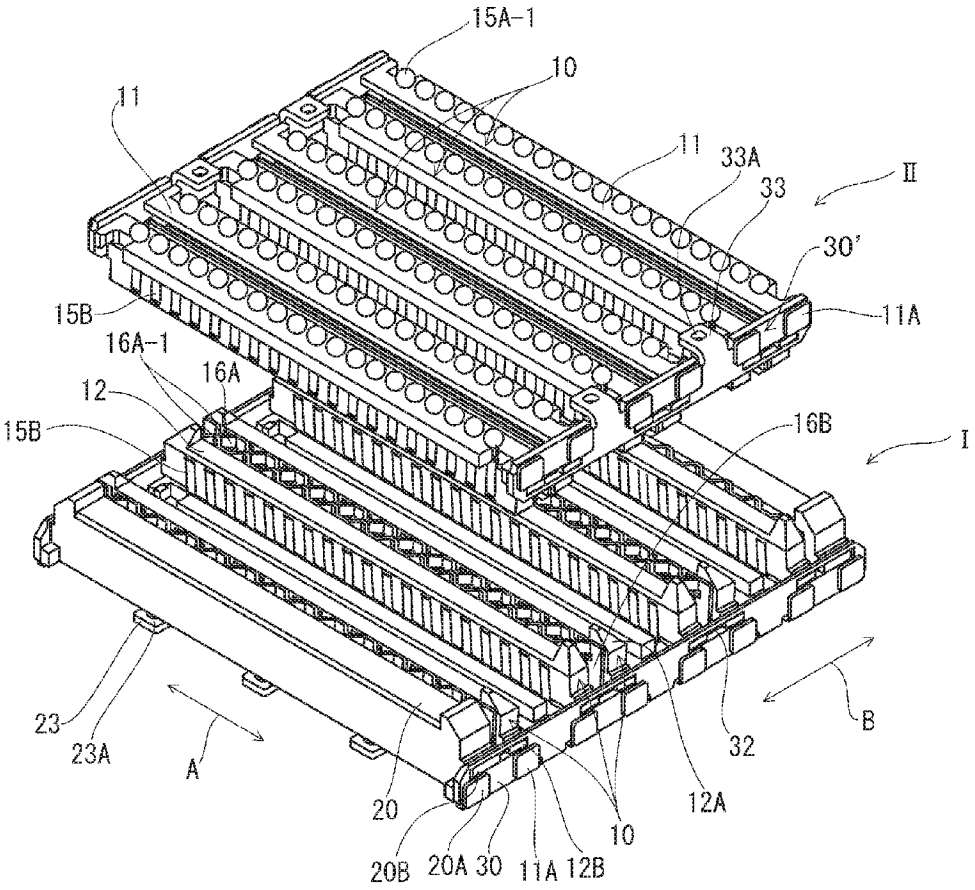
FIG. 1 illustrates an oblique view depicting a state obtained before a pair of connectors of an embodiment of the present invention are mated.
Figure 2:
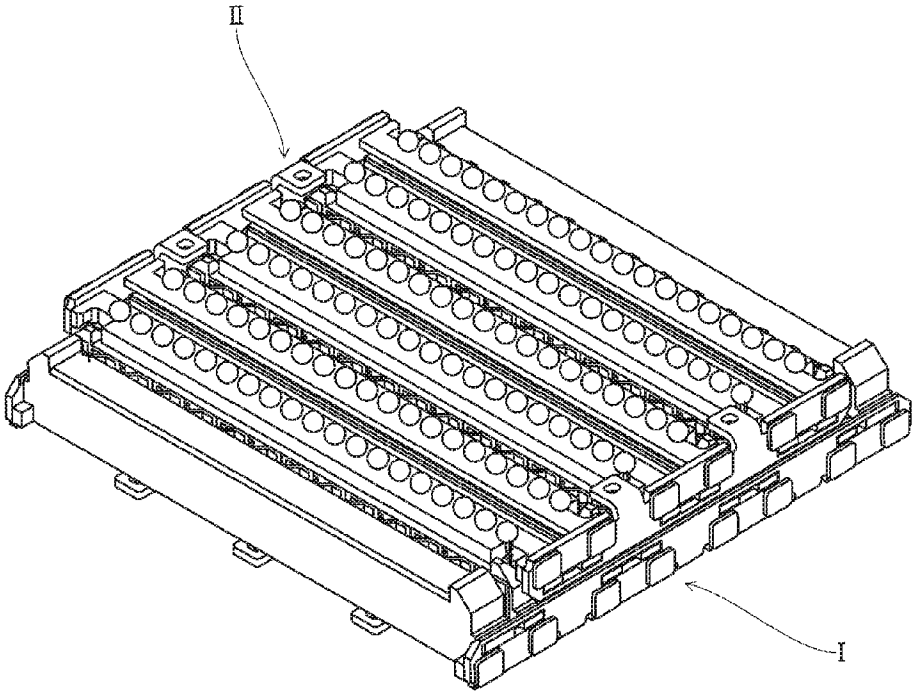
FIG. 2 illustrates an oblique view depicting a state obtained after mating the pair of connectors illustrated in FIG. 1.

FIG. 1 and FIG. 2 are oblique views illustrating an electrical connector for circuit boards I used in the present embodiment (hereinafter referred to as "connector I") and a counterpart connector II (hereinafter referred to as "connector II"), where FIG. 1 shows a state obtained before the two connectors I, II are mated and FIG. 2 shows a state obtained after mating. In the counterpart connector II, the same reference numerals are assigned to components in common with the components of connector I. In addition, since the above-mentioned common components of the two connectors I, II are visible only in parts of connector I or connector II in the oblique view of FIG. 1, said common components will be described with reference to both connectors I and II.

Connectors I, II have multiple connection elements 10. In the example illustrated in FIG. 1, each of them has six connection elements. These connection elements 10 extend such that the array direction of the terminals is the longitudinal direction A. In connector I, they are secured in place in array form by a support 30, and in connector II, they are secured in place in array form by a support 30' such that their array direction B is a direction perpendicular to the above-mentioned longitudinal direction. The number of connection elements 10 in connectors I and II is the same, but their array configuration is different. For this reason, while the configurations of the support 30 and support 30', which support the connection elements 10, are carbon copies of each other, they are different in size (length in the array direction B). Connector I is described below with reference to connector II.

As far as the multiple connection elements 10 in connector I are concerned, the connection elements 10 positioned on both end sides in the array direction B are isolated, and, in addition, two connection elements 10 are symmetrically grouped to form pairs between these two end positions. The end wall members 20 extending in the above-mentioned longitudinal direction A in parallel to said connection elements 10 are placed in parallel to each other at the connection elements 10 located on above-mentioned both end sides, and all the connection elements 10 (in FIG. 1, a total of 6 connection elements 10) and the above-mentioned end wall members 20 are supported by supports 30 extending in the array direction B at both ends in the above-mentioned longitudinal direction A. Said supports 30 and the end wall members 20 are combined to form a single quadrangular frame, with all the connection elements 10 in the frame arranged and supported in parallel to one another.

On the other hand, in connector II, the above-mentioned connection elements 10 are disposed symmetrically in the array direction B so as to form pairs and these pairs are positioned at three locations in the array direction B, with a total of six connection elements 10 supported by the supports 30'. Connector II does not have members corresponding to the end wall members 20 in connector I and the above-mentioned supports 30' in connector II are accordingly shorter than the supports 30 in connector I. With the exception of this difference in length, the supports 30' of connector II have the same configuration as the supports 30 of connector I.

Figure 4:
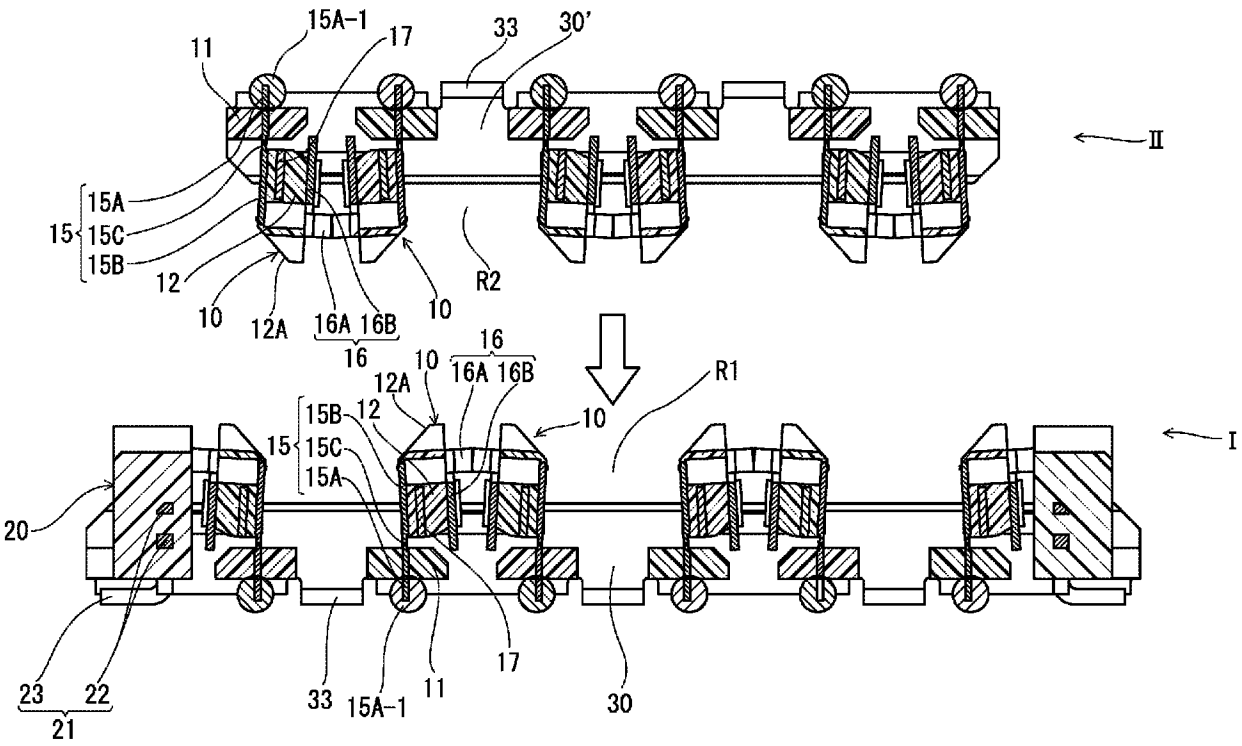
FIG. 4 illustrates a vertical cross-sectional view depicting a state obtained before the pair of connectors illustrated in FIG. 1 are mated.

As can be seen from FIG. 4, which shows a cross-section taken prior to the mating of connectors I and II along a plane normal to the longitudinal direction A, in other words, a plane that extends in the array direction B and in the height direction, the connection elements 10 have stationary retainers 11 and movable retainers 12 of an electrically insulating material, terminals of metallic material 15 extending between, and secured in place by, the stationary retainers 11 and movable retainers 12, biasing members of metallic material 16 secured in place by the movable retainers 12, and, in addition, shielding plates of metallic material 17 secured in place by the movable retainers 12.

As can be seen in FIG. 1, when connector I and connector II are disposed on, and connected to, a circuit board, the stationary retainers 11 of connector I and connector II, which are positioned closer to said circuit board, extend in the longitudinal direction A. In addition, the movable retainers 12, which extend in parallel to said stationary retainers 11 in said longitudinal direction A, are provided in the height direction of the connector in spaced relation to the above-mentioned stationary retainers 11 in positions located farther away from the above-mentioned circuit board than the stationary retainers 11. As can be seen in FIG. 4, the cross-sectional shape of the stationary retainers 11 has smaller dimensions in the height direction (connector mating direction) than in the width direction (array direction B) and, by contrast, the movable retainers 12 are configured to have larger height dimensions than their dimensions in the width direction. The stationary retainers 11 and movable retainers 12 will be discussed again hereinbelow in conjunction with the shielding plates, supports, and the like.

Figure 6:
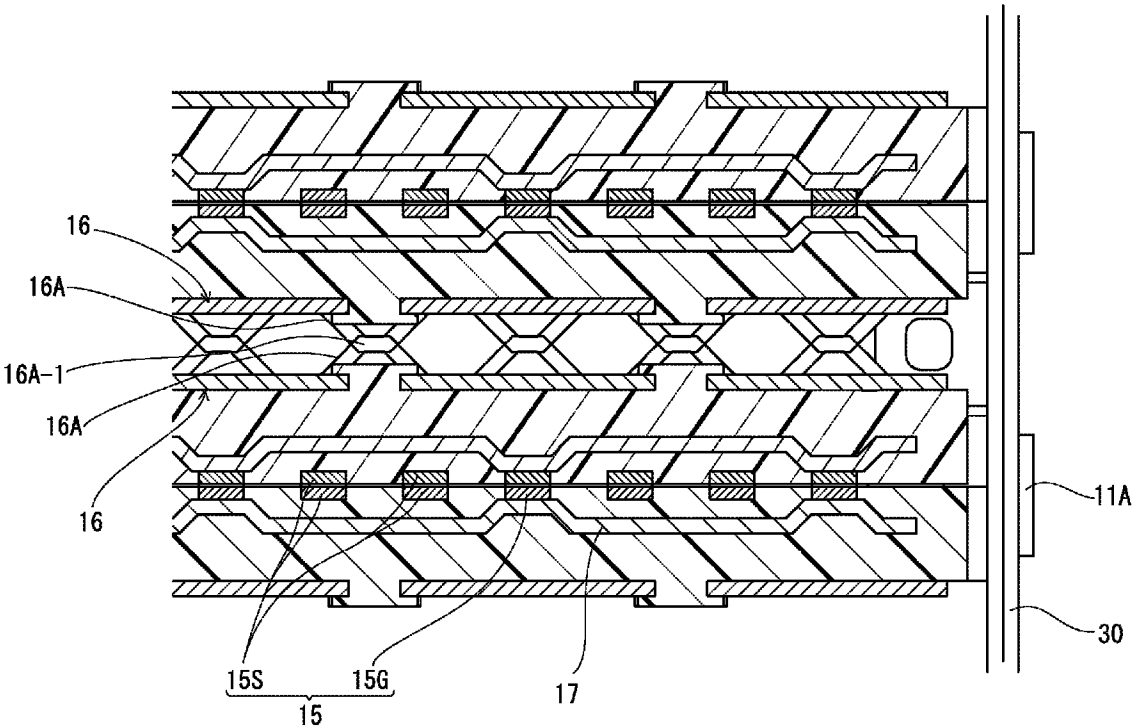
FIG. 6 illustrates an enlarged partial horizontal cross-section of the two connectors illustrated in FIG. 5 taken in the height direction, at the location of the movable retainer.

The terminals 15 have a linear belt-shaped configuration, and, as can be seen in FIG. 4, they pass through the stationary retainers 11 in the height direction and are positioned on one of the lateral faces of the movable retainers 12 that form the opposed outer lateral faces of a pair of connection elements 10, with each of the stationary retainers 11 and movable retainers 12 secured in place using unitary co-molding. In said terminals 15, connecting portions 15A used for connection to a circuit board are formed at one end of said terminals 15 that pass through the above-mentioned stationary retainers 11, and solder balls 15A-1 used for solder-connection to the circuit board are provided on said connecting portions 15A. On the other hand, the sections of said terminals 15 located on one of the lateral faces of the movable retainers 12 are exposed on said lateral face and have formed thereon contact portions 15B that come into contact with counterpart terminals provided in the counterpart connector (in this embodiment, the terminals of connection elements 10 of identical configuration). Said contact portions 15B extend in a flat belt-shaped configuration. Their distal ends are shaped as projections, with contact point portions 15B-1 (see FIG. 3) formed at the ends, thereby creating an electrically simple straight transmission path, creating a so-called stubless configuration, and providing for superior transmission characteristics. In the above-mentioned terminals 15, sections positioned between the above-mentioned stationary retainers 11 and the movable retainers 12, which are secured in place neither by the stationary retainers 11 nor by the movable retainers 12, are formed to be locally thinner than other portions, are liable to undergo resilient flexure in the through-thickness direction of said terminals 15 (i.e., in the lateral direction, that is, the array direction B), and have flexible portions 15C formed therein. As far as the terminals 15 are concerned, all the multiple terminals 15 arranged in the longitudinal direction A can be used as signal terminals for each connection element 10. However, in this embodiment, two adjoining terminals are used as differential pairs of paired signal terminals, and terminals positioned between said differential pairs are used as ground terminals. FIG. 6, which shows a cross-section of the two connectors I, II in a mated state, illustrates their appearance. The signal terminals are indicated by the reference numeral "15S" and the ground terminals are indicated by the reference numeral "15G". As can be seen in FIG. 6, the signal terminals 15S (two pairs) of the two connectors I and II, which are in contact with each other, are surrounded by the respective shielding plates 17, and said shielding plates 17 are grounded by the ground terminals 15G. As can be seen in FIG. 6, when the connectors are mated, the differential pairs of the above-mentioned signal terminals 15S are surrounded by the shielding plates 17, thereby providing for superior transmission characteristics.

The shielding plates 17 are secured in place by being embedded in the above-mentioned movable supports 12 using unitary co-molding. Said shielding plates 17 extend far in the above-mentioned longitudinal direction A across the entire array region of the terminals 15 (signal terminals 15S and ground terminals 15G) and, as can be seen in FIG. 6, while they are spaced apart from the signal terminals 15S, their locally curved sections are in contact with the ground terminals 15G.

Figure 3:
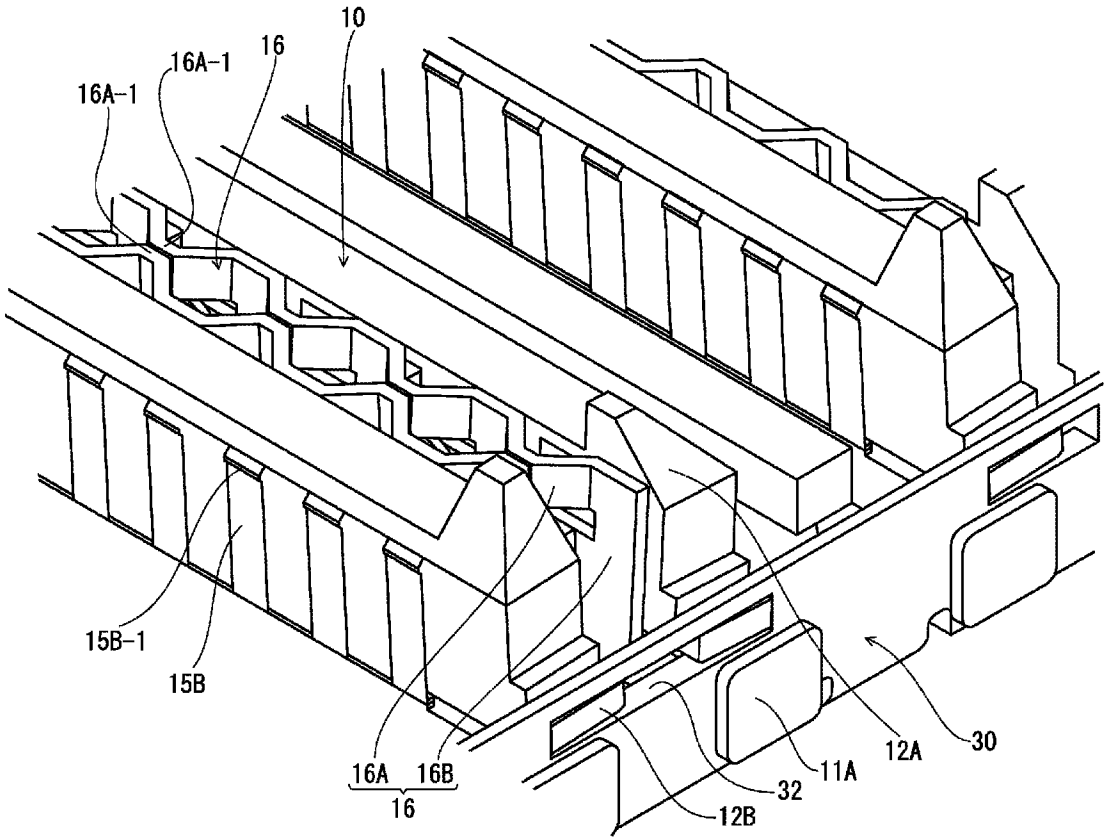
FIG. 3 illustrates an enlarged partial oblique view of one of the connectors illustrated in FIG. 1.

As can be seen in FIG. 4, in the above-mentioned movable retainers 12, biasing members 16 are provided on the lateral faces on the side opposite to the lateral faces where the terminals 15 are disposed. Said biasing members 16, which are made of metal plates and extend across the entire array region of the terminals 15, have spring portions 16A, which are capable of elastic deformation, and retained portions 16B, which are secured in place on the above-mentioned other lateral faces of the movable retainers 12. Although in the case illustrated in the figure the biasing members 16 are made of metal plates, they can also be made of an insulating material. The spring portions 16A are located on the other lateral faces of the above-mentioned movable retainers 12, in positions spaced away from the stationary retainers 11 in the height direction of the connector, namely, at the ends of said movable retainers 12, and, as can be seen in FIG. 1, FIG. 3, and FIG. 6, form a corrugated configuration with repeating peak and trough portions in the longitudinal direction A. They have peak portions 16A-1 spaced away from the other lateral faces of said movable retainers 12 at the location of the movable retainers 12 in above-mentioned longitudinal direction A and, in addition, trough portions 16A-2 formed between two movable retainers 12 adjacent in the above-mentioned longitudinal direction A. When acted upon by external forces, the above-mentioned peak portions 16A-1 can undergo elastic deformation in the height direction of said peak portions 16A-1. The cross-sectional view of FIG. 6, which illustrates a state obtained after mating the two connectors I, II, shows that the spring portions 16A of the two connectors I, II are pushing against each other at the peak portions 16A-1 by seeming to show the peak portions 16A-1 as overlapping. However, no actual overlapping takes place, as illustrated in FIG. 1, and the elastic deformation that takes place corresponds to the extent of the illustrated mutual pressure and overlapping. As described above, the above-mentioned spring portions 16A are positioned at the ends of the movable retainers 12, and since this is a position in the height direction corresponding to the contact points 15B-1 formed at the distal ends of the above-described contact portions 15B, adequate contact is ensured between the contact portions 16 and the above-mentioned contact points 15B-1. In addition, although the retained portions 16B have a flat belt-shaped configuration extending in the above-mentioned longitudinal direction A in parallel with the above-mentioned spring portions 16A and are formed to be spaced away from the above-mentioned spring portions 16A, they are coupled to the spring portions 16A only at the two ends of the movable retainers 12 in the above-mentioned longitudinal direction A, thereby forming a single biasing member 16. The retained portions 16B are secured in place by unitary co-molding with the movable retainers 12. In this manner, the movable retainers 12, which hold the terminals 15, biasing member 16, and shielding plates 17 in place, are coupled to the stationary retainers 11 such that the terminals 15 are secured in place by another stationary retainer 11. Said movable retainers 12 are provided with prismatic guide portions 12A that protrude toward the counterpart connector at both ends in the above-mentioned longitudinal direction A and have inclined faces on the opposed external sides of a pair of connection elements 10 (see FIGS. 1, 4). Furthermore, the movable retainers 12 are provided with restricted portions 12B in the shape of flat projections that protrude in said longitudinal direction A at both ends in the above-mentioned longitudinal direction A and are movably restricted in terms of position by the hereinafter described supports 30 (see FIGS. 1, 3). On the other hand, the stationary retainers 11 coupled through the medium of the terminals 15 and said movable retainers 12 are provided with fixed portions (not shown), which protrude in the above-mentioned longitudinal direction A, in the same direction as the movable retainers 12. After passing through the corresponding fixing holes in the hereinafter described supports 30, the sections of said fixed portions that protrude from said fixing holes are heated, softened, and then crushed, thereby forming fixing portions 11A, such that said stationary retainers 11 are secured in place and supported by the supports 30.

As can be seen in FIG. 3, FIG. 4, and FIG. 6, in a pair of connection elements 10 formed in this manner, the biasing members 16 of the connection elements 10 abut each other with the peak portions 16A-1 of the spring portions 16A. Before the connectors are mated, these peak portions 16A-1 are in a free state and exhibit no elastic deformation. For this reason, as can be seen in FIG. 4, the movable retainers 12 are positioned so as to be tilted away from each other.

In connector I, there are also provided end wall members 20, which are placed in parallel to the isolated connection elements 10 located at both ends in said array direction B among the six connection elements 10 arranged side-by-side in the array direction, and, at their ends in the longitudinal direction A, there are provided protruding fixed portions (not shown) similar to those of the stationary retainers 11. After passing through the corresponding fixing holes in the supports 30, the protruding sections are heated and then crushed, thereby forming fixing flanges 20A. At their ends in the longitudinal direction A, the above-mentioned end wall members 20 are provided with restricted portions 20B in the shape of flat projections similar to those of the movable retainers 12. However, since said end wall members 20 are not divided into stationary sections and movable sections and are stationary as a whole, the above-mentioned restricted portions 20B are not only restricted by the hereinafter described supports 30, but also supported in a fixed position.

Reinforcing members 21 made of metal plates are embedded in the above-mentioned end wall members 20. Since the two biasing members 16 of two paired connection elements 10 act on each other with oppositely directed biasing forces in the array direction B, the biasing forces cancel each other out. However, the biasing forces in the isolated connection elements 10 located at both ends in the above-mentioned array direction B are received only by the above-mentioned end wall members 20. Accordingly, the reinforcing members 21 have sections embedded in the end wall members 20, thereby providing reinforcement. In said reinforcing members 21, there are provided attachment legs 23, which protrude downwardly and which are used to firmly secure said end wall members 20 to the circuit board by soldering. Solder holes 23A used to ensure adequate soldering are also formed in said attachment legs 23.

The above-mentioned supports (supports 30 in connector I and supports 30' in connector II) are formed as metal bands extending in the array direction B along the end faces of the ends of the above-mentioned connection elements 10 and end wall members 20 in the longitudinal direction A and, in connector II, along the end faces of the ends of the above-mentioned connection elements 10 in the longitudinal direction A. Said supports 30 have formed therein fixing holes (not shown), into which the fixed portions 11A of the stationary retainers 11 and the fixed portions of the end wall members 20 are inserted, and, furthermore, have formed therein restricting holes 32, into which the restricted portions 12B of the movable retainers 12 and the restricted portions 20B of the end wall members 20 are inserted.

The above-mentioned fixing holes and restricting holes 32 are provided in pairs within the space between two connection elements 10 paired in the array direction B. Namely, two fixing holes constitute a pair at the lower edge of the supports 30 and a plurality of such pairs are formed in the above-mentioned array direction B; two restricting holes 32 constitute a pair at the upper edge of the support 30 and a plurality of such pairs are formed in the above-mentioned array direction B. In the case of connector I, the supports 30 have four pairs of restricting holes 32 and fixing holes in the array direction B and provide support to pairs formed by the end wall members 20 and the connection elements 10 located at the two ends in said array direction B as well as to two pairs of connection elements 10 located between the above-mentioned two ends in predetermined positions. Along with using the above-mentioned restricting holes 32 to movably (tiltably) restrict and support the restricted portions 12B of the movable retainers 12, said supports 30 restrict and support the restricted portions 20B of the end wall members 20 in fixed positions and use the fixing holes to secure in place and support the fixed portions 11A of the stationary retainers 11 and the restricted portions 20B of the end wall members 20. In the case of connector II, the supports 30', which have three pairs of restricting holes 32 and fixing holes, use the restricting holes 32 to restrict and support the restricted portions 12B of the movable retainers 12 of the connection elements 10 and use the fixing holes to secure in place and support the fixed portions 11A of the stationary retainers 11.

The above-mentioned supports 30 and 30' are provided with attachment legs 33 bent in an L-shaped configuration at positions tangent to the circuit board (not shown) in the height direction of the connector. Said attachment legs 33 are formed for solder attachment to the circuit board and have solder holes 33A formed therein in order to ensure adequate soldering.

Thus, as can be seen in FIG. 1 and FIG. 4, connector I is formed by supporting pairs formed by the end wall members 20 and the connection elements 10 disposed at the two ends in the array direction B, as well as two pairs of connection elements 10 located between the above-mentioned two ends with the help of the supports 30, and connector II is formed by supporting three pairs of connection elements 10 in the above-mentioned array direction B with the help of the supports 30'. In the thus formed connector I, receiving portions R1 are formed that receive pairs of connection elements 10 of the above-mentioned connector II in the spaces between two pairs of connection elements 10 in the array direction B and spaces lateral to each respective pair of connection elements 10, and on the other hand, in connector II, receiving portions R2 are formed that receive pairs of connection elements 10 of connector I between adjacent pairs of connection elements 10.

The thus formed connectors I, II are employed in the following manner.

First, each of connectors I, II is mounted to a corresponding circuit board. The mounting of the connectors is performed by solder-connecting them with the aid of the solder balls 15A-1 provided on the connecting portions 15A of the terminals 15 of each connection element 10 and by solder-mounting using the attachment legs 33 of the supports 30, 30'.

When connector I and connector II are attached to the corresponding circuit boards, two paired connection elements 10 abut each other via the respective spring portions 16A of the biasing members 16 (in the case of connector I, the spring portions A of the biasing members 16 of the isolated connection elements 10 positioned at both ends in the array direction B abut the end wall members 20) with a certain biasing force, as a result of which, as can be seen in FIG. 4, before the connectors are mated, the connection elements 10 undergo deflection in the flexible portions 15C of the terminals 15 and the movable retainers 12 are tilted in the direction of the above-mentioned biasing force.

Next, as shown in FIG. 4, while the connection elements 10 are deflected in the area of the movable retainers 12, connector II is placed above connector I and the pairs of connection elements 10 of said connector II are positioned directly above the receiving portions R1 of connector II, after which said connector II is lowered without changing its orientation. When said connector II is lowered, each pair of connection elements 10 of said connector II, guided by the guide portions 12A of both connectors I and II, enters a receiving portion R1 in connector I and, in addition, each pair of connection elements 10 of connector I enters a receiving portion R2 in connector II.

Figure 5:
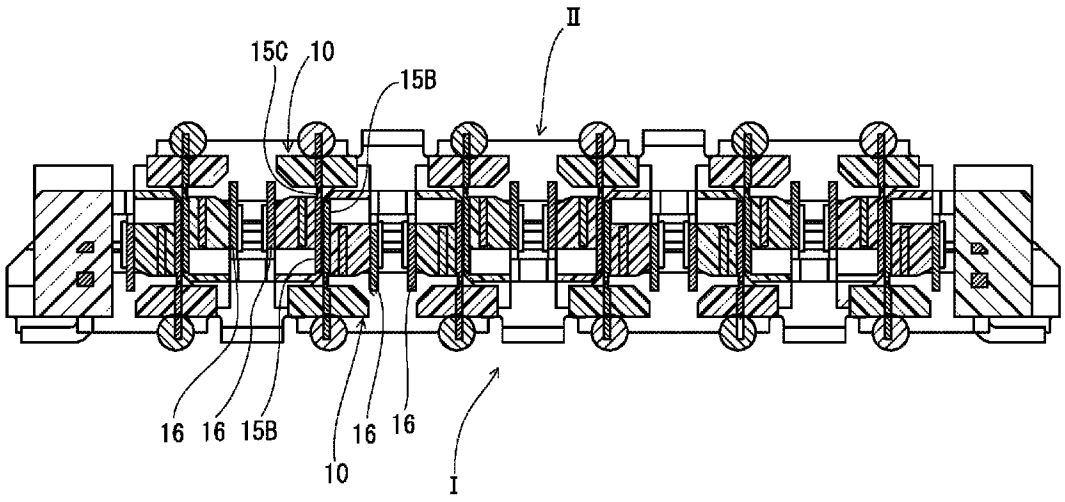
FIG. 5 illustrates a vertical cross-sectional view depicting a state obtained when the pair of connectors illustrated in FIG. 1 are mated in the normal position.

When the paired connection elements 10 enter the above-mentioned receiving portions R1 and R2, each connection element 10 is electrically connected to a corresponding connection element 10 in the counterpart connector. In other words, the contact points 15B-1 provided in the contact portions 15B of the terminals 15 of one connection element 10 of the two paired connection elements 10 in one of the connectors, and the contact portions 15B of the terminals 15 of the connection elements 10 of the other counterpart connector, as well as the contact portions 15B of the terminals 15 of the connection elements 10 and the contact points 15B-1 provided in the contact portions 15B of the terminals 15 of the connection elements 10 of the other counterpart connector push against each other in the above-mentioned array direction B, as a result of which contact pressure is applied to the contact portions 15B between the terminals 15 of the two connection elements 10. The terminals 15 in each respective connection element 10 of one of the connectors, with their contact portions 15B, apply the above-mentioned contact pressure to the contact portions 15B of the terminals 15 in the connection elements 10 of the counterpart connector. As a result, under the action of the reaction force between the contact portions 15B of the two connectors I, II, the connection elements 10 of both connectors I, II reduce the initial flexure in the flexible portion 15C of these terminals 15, and the tilted orientation of the movable retainers 12 prior to connector mating is corrected. At this point, the spring portions 16A of the respective biasing members 16 in a pair of connection elements 10 of connector I and a pair of connection elements 10 of connector II are mutually compressed and displaced, thereby permitting correction of the orientation of the above-mentioned movable retainers 12. The reaction force between these spring portions 16A is in balance with the contact force due to the contact pressure between the above-mentioned contact portions 15B (see FIG. 5, which shows a state after connector mating).

Figure 7:
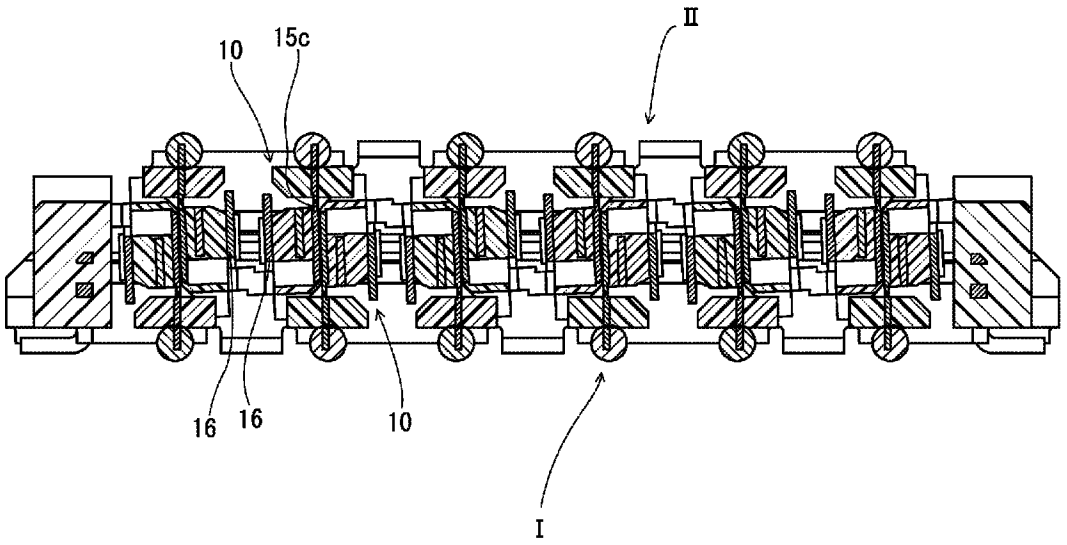
FIG. 7 illustrates a vertical cross-sectional view depicting a state obtained when the pair of connectors illustrated in FIG. 1 are mated in a floating manner.

Thus, in some cases, the mated connectors I, II after mating, or the respective circuit boards prior to mating, are displaced from their normal positions. In such cases, in this embodiment, two connection elements 10 having contact pressure between the contact portions 15B of the terminals 15 maintain adequate contact of the contact portions 15A in a so-called floating state, wherein, as can be seen in FIG. 7, flexure is generated in the flexible portions 15C of the respective terminals 15 to an extent corresponding to the amount of the above-mentioned displacement and this displacement is absorbed.

In this manner, in the present invention, the contact portions 15B of the terminals 15 are positioned within the range in the height direction of the movable retainers 12 on one side of said movable retainers 12, the biasing members 16 are provided on the other side of the movable retainers 12, and the flexible portions 15C of the terminals are located between the stationary retainers 11 and the movable retainers 12. This ensures the contact pressure of the terminals and makes floating possible, while at the same time minimizing the height dimensions of the connector.

DESCRIPTION OF THE REFERENCE NUMERALS

10 Connection element
11 Stationary retainer
12 Movable retainer
15 Terminal
15A Connecting portion
15B Contact portion
15C Flexible portion
16 Biasing member
17 Shielding plate
I Connector
II Connector

The invention claimed is:

1. An electrical connector assembly for circuit boards comprising a first disposed on a mounting surface of a circuit board, wherein said connector assembly comprises:

a plurality of connection elements arranged such that a direction parallel to the mounting surface of the circuit board is the array direction, and supports that support said plurality of connection elements; said connection elements have terminals that connect to counterpart terminals provided in a counterpart connector and stationary retainers and movable retainers of an electrically insulating material that secure said terminals in place; said terminals have connecting portions connected to the mounting surface at one end in the longitudinal direction of said terminals and contact portions that come into contact with the counterpart terminals at the other end in the longitudinal direction, said contact portions being secured in place on one lateral face of the movable retainers and secured in place by the stationary retainers between said movable retainers and the above mentioned connecting portions, with flexible portions formed between the movable retainers and the stationary retainers; said movable retainers have biasing members provided on the other lateral face opposite to the lateral face on which the contact portions are located; and, when the first connector is connected to the counterpart connector, said biasing members apply pressure to other adjacent connection elements with a biasing force, as a result of which their reaction force causes the contact portions to come into contact with the counterpart terminals of the counterpart connector and apply a contact pressure thereto.

2. The electrical connector for circuit boards according to claim 1, wherein the connection elements are paired by being disposed such that the surfaces on which the biasing members are provided face each other.

3. The electrical connector for circuit boards according to claim 2, wherein the paired connection elements are such that the counterpart terminals of the counterpart connector are positioned on both external sides on which the contact portions of the two connection elements are located.

4. The electrical connector for circuit boards according to claim 1, wherein the connection elements have shielding plates secured in place by the movable retainers so as to be positioned between the terminals and the biasing members.

5. The electrical connector assembly according to claim 1, wherein the counterpart connector comprises connection elements of the same configuration as said first connector.

* * * * *